United States Patent [19]

Buck et al.

[11] Patent Number: 4,791,900

[45] Date of Patent: Dec. 20, 1988

[54] SAFETY AND EMERGENCY DRIVING METHOD FOR AN INTERNAL COMBUSTION ENGINE WITH SELF-IGNITION AND AN ARRANGEMENT FOR THE PERFORMANCE OF THIS METHOD

[75] Inventors: Rainer Buck, Tamm; Werner Fischer, Ditzingen; Hermann Kull, Stuttgart; Albrecht Sieber, Ludwigsburg; Wolf Wessel, Obberriexingen, all of Fed. Rep. of Germany

[73] Assignee: Robert Bosch GmbH, Stuttgart, Fed. Rep. of Germany

[21] Appl. No.: 885,166

[22] Filed: Jul. 14, 1986

[30] Foreign Application Priority Data

Aug. 31, 1985 [DE] Fed. Rep. of Germany ..... 3531198

[51] Int. Cl.[4] ..... F22B 21/24

[52] U.S. Cl. ..... 123/359; 123/352

[58] Field of Search ..... 123/339, 352, 350, 399

[56] References Cited

U.S. PATENT DOCUMENTS 4,401,075 8/1983 O'Keefe .

4,603,675 8/1986 Junginger ..... 123/352

*Primary Examiner*—Raymond A. Nelli

*Attorney, Agent, or Firm*—Michael J. Striker

[57] ABSTRACT

In a safety and emergency driving control method and an associated arrangement for an internal combustion engine with self-ignition used to power a motor vehicle, various operating parameters of the engine are continuously monitored and respective signals indicative of gas pedal position, engine operating speed, brake actuation, and actual control rod displacement are generated and evaluated to determine simultaneous occurrence of a modified idling operation condition and of a predetermined minimum value of the actual control rod displacement signal. In response to such a simultaneous occurrence the engine control is switched over to another regulation branch which controls the control rod displacement in accordance with a minimum value characteristic line of the control rod displacement. Further peripheral devices are included for providing starting hysteresis and excess speed protection, and for supervising the operation of the control rod displacement sensor. A supervisory device associated with a main computer of the arrangement may also be used to achieve the switch-over independently ofexternal signals.

15 Claims, 4 Drawing Sheets

SAFETY AND EMERGENCY DRIVING METHOD FOR AN INTERNAL COMBUSTION ENGINE WITH SELF-IGNITION AND AN ARRANGEMENT FOR THE PERFORMANCE OF THIS METHOD

BACKGROUND OF THE INVENTION

The present invention relates to the control of internal combustion engines in general, and more particularly to a method of and an arrangement for operational safety and emergency driving control of an internal combustion engine with self-ignition.

There are already known various methods and arrangements for safety and emergency driving control of internal combustion engines with self-combustion, wherein signals indicative of the instantaneous operating condition of the internal combustion engine (gas pedal position signal, operating speed of the engine signal, brake position or braking light signal, and actual regulation bar position signal) are being continuously gathered and evaluated, and the operation of the engine is controlled on the basis of such parameters. It is also known to utilize electric adjustment arrangements which are controlled by electrical signals for an electronic regulation of the operation of internal combustion engines with self-ignition (Diesel engines). In this case, a central control arrangement instead of previously customary fuel metering and regulating systems, generates the requisite adjustment or regulation signals. While it is true that mechanical fuel metering systems for use in Diesel engines are to be considered reliable as far as their resistance to breakdown or failure is concerned, they are, under certain circumstances, unable to take into consideration the multitude of various operating conditions and environmental influences which are expected to be satisfied nowadays.

The utilization of electronic components in conjunction with an electronic Diesel engine control (EDC) makes it desirable to provide for extensive safety, monitoring and emergency driving measures even when the individual structural components themselves already contain provisions for failure recognition and, as the case may be, even failure correction.

It is also already known in a safety arrangement for an internal combustion engine with self-ignition, for instance, from the published German application DE-OS No. 33 01 742, to provide or gather continuously generated signals which are related to the operation of the internal combustion engine, such as, for instance, the gas pedal position, calculated desired value of the control rod displacement, engine operating speed, brake pedal position, and the like, and to form a corrected displacement value by minimum value of the control rod selection and furnish this corrected value to the adjustment regulator or controller of the EDC arrangement. This corrected value simultaneously serves for the determination of a deviation of the control rod displacement by taking into consideration the actual value of the control rod travel which is being fed back. Then, if predetermined limits are exceeded, the known operational safety arrangement reacts either by switching off the injection pump, or by switching off the electric current supply to the end stage of the adjustment regulator or controller, or by initiating an emergency driving operation. However, under certain circumstances, problems can be encountered during the operation of this known safety arrangement, since not all of the imaginable boundary or marginal conditions are taken into consideration during the establishment of the operational safety conditions. So, for instance, while is is true that it is possible to obtain an idling signal by providing a corresponding idling operation contact at the gas pedal, the thus obtained idling signal is not valid or applicable when, for instance, the internal combustion engine is provided with a driving speed regulation. Moreover, it can be contemplated that, for whatever the reasons may be (sporty driving, warning of following motorists and the like), the driver briefly actuates or even merely taps the brake pedal while the gas pedal remains in its depressed position, that is, it is not in its idling position. Thus, it may be seen that the known arrangements possess many drawbacks and at least potential problems, so that they still leave much to be desired particularly in terms of accuracy of the regulating function performed thereby.

SUMMARY OF THE INVENTION

Accordingly, it is a general object of the present invention to avoid the disadvantages of the prior art.

More particularly, it is an object of the present invention to provide an operational safety and emergency driving method which does not possess the disadvantages of the known methods of this kind.

Still another object of the present invention is to provide an electronic Diesel control arrangement with a device which ensures an improved operational safety and emergency driving operation of the vehicle.

It is yet another object of the present invention to develop such an improved device which prevents racing or overspeeding of the engine under all circumstances, while also providing, in a far-reaching manner, for emergency driving operation of the vehicle.

An additional object of the present invention is to develop a device of the aforementioned type which is capable of properly taking into consideration and reacting to marginal operational conditions, which are not ordinarily expected to occur, such as simultaneous operation of both the gas pedal and the brake pedal.

A concomitant object of the present invention is so to construct the device of the above type which is relatively simple in construction, inexpensive to manufacture, easy to use, and reliable in operation.

In pursuance of these objects and others which will become apparent hereafter, one feature of the present invention resides in a method of operational safety and emergency driving control for an internal combustion engine with self-ignition used to power a motor vehicle, comprising the steps of continuously monitoring various operating parameters of the engine, including generating respective signals indicative at least of gas pedal position, engine operating speed, brake actuation, and actual control rod displacement; evaluating such signals, including determining simultaneous occurrence of a modified idling operation condition and of a predetermined minimum value of the actual control rod displacement signal; and controlling the operation of the engine on the basis of the evaluation step, including controlling the control rod displacement in a predetermined manner in the absence of such simultaneous occurrence, and switching, in the presence of such simultaneous occurrence, to another control rod branch which controls the regulation displacement in accordance with a predetermined minimum value characteristic of the control rod displacement.

A particular advantage of the method of the present invention as described so far is that the regulation of the engine is switched over, when a safety condition is in effect, to a displacement of the control rod (of the injection pump) which regulation is not dangerous either to the internal combustion engine or to the driving operation. Simultaneously, sharp tongue jumps resulting from an erroneous fuel amount signal delivered by a main computer, are avoided.

Advantageously, the controlling step further includes adding the signal indicative of the gas pedal position to an engine speed dependent control-rod displacement minimum value obtained from the control-rod displacement value characteristic behavior line for emergency driving operation to obtain a new desired regulation displacement value which renders a broadened emergency driving operation possible. The controlling step may further include switching the adjustment regulation with the new characteristic behavior line dependent and gas pedal dependent desired control rod displacement value from a normal adjustment regulator to an auxiliary redundant regulator for simultaneous protection against disturbances in the operation of the normal adjustment regulator.

It is further advantageous when the controlling step further includes producing the control-rod displacement minimum value characteristic behavior line for the emergency driving operation from the engine speed as determined by an engine speed sensor during the performance of the generating step. The generating step may include employing the engine speed sensor for effectively sensing injection commencement, or for sensing rotation of a crankshaft of the engine, while reducing the number of the redundant signals obtained from the engine speed sensor by division.

According to another advantageous aspect of the present invention, the engine speed dependent control-rod displacement characteristic line includes a starting hysteresis function which releases an additional fuel amount in dependence on the engine speed for the cold start and which switches over to the normal regulation of the control rod displacement according to a minimum value characteristic line upon the reaching of a normal starting termination engine speed for the first time. A particular advantage of this approach is that, even when switching to a minimum control-rod displacement characteristic line is to be performed, the automatic starting fuel amount control, for instance, during a cold start, is still available and the regulation is returned to the normal control-rod displacement characteristic line only after the so-called normal starting termination speed is exceeded for the first time.

Advantageously, the evaluating step includes, for the presentation of the modified idling operation signal, performing at least one of comparisons of a brake pedal actuation signal with a driving speed regulating signal, and of a non-occurrence of the driving speed regulating signal with a foot pedal normal idling operation signal. Then, the controlling step includes utilizing the modified idling operation signal to cause permanent switching-over only after the expiration of a predetermined time delay and when a condition that the actual control-rod displacement value exceeds the minimum displacement value is simultaneously satisfied. The controlling step may additionally include selectively circumventing the utilizing step and using a signal directly issued by a separate monitoring device associated with a main computer for achieving the permanent switching-over.

It is further proposed for the evaluating step to include detecting a failure of an actual control-rod displacement value sensor, and switching over to a simulated actual value signal derived from the output of a adjustment regulator. The evaluating step may further include, for achieving a permanent switching-over, setting a reaction component, and resetting the reaction component in the absence of the modified idling signal.

In accordance with another facet of the present invention, the engine speed dependent control-rod displacement characteristic line includes a starting hysteresis function which releases an additional fuel amount in dependence on the engine speed for the cold start and which switches over to the normal control-rod displacement according to a minimum value characteristic line upon the reaching of a normal starting termination engine speed for the first time; and wherein the resetting of the reaction component is performed even during the occurrence of the starting hysteresis function.

The present invention is also directed to a safety and emergency driving control method for an internal combustion engine with self-ignition used to power a motor vehicle, which method comprises the steps of continuously monitoring various operating parameters of the engine, including generating respective signals indicative at least of gas pedal position, engine operating speed, brake actuation, actual regulation displacement, and regulation deviation and starting position of an adjustment regulator having an integrating section; evaluating such signals, including determining a failure of the adjustment regulator to reach a starting abutment value upon the expiration of a predetermined time interval; and controlling the operation of the engine on the basis of the evaluation step, including switching to a substitute regulator in response to determination of such failure during the evaluation step. The controlling step may include supplying to the substitute regulator the same desired value for the control-rod displacement as that supplied to the adjustment regulator, or an emergency driving desired value for the control rod displacement.

Another advantageous feature of this invention is obtained when the controlling step includes supplying to the djustment regulator, after the switching to the substitute regulator, a fixed desired value, while continuing to monitor its starting position during the evaluating step, and switching back from the substitute regulator to the adjustment regulator after the operability of the adjustment regulator has been recognized from a predetermined number of arrivals at the starting abutment value.

The present invention also proposes a safety and emergency driving control method for an internal combustion engine with self-ignition used to power a motor vehicle, this method comprising the steps of continuously monitoring various operating parameters of the engine, including generating respective signals indicative at least of gas pedal position, engine speed, brake actuation, actual control rod displacement, and driving speed; evaluating such signals, including examining the signals generated during the monitoring step for an indication of the occurrence of a first condition encountered when the brake has been actuated while the gas pedal was out of its idling position, and of a second condition encountered when the gas pedal has been moved out of its idling position while the brake is activated and simultaneously the driving speed exceeds a predetermined minimum value; and controlling the operation of the engine on the basis of the evaluation step, including instituting a safety driving operation only upon the detection during the evaluation step of the occurrence of one of the first and second conditions, for avoiding unwarranted reduction in the amount of injected fuel. The controlling step may further include commencing a waiting period of a predetermined duration at the beginning of the safety driving operation, gradually reducing the injected fuel amount with time in accordance with a ramp function having a predetermined slope upon the expiration of the waiting period until a predetermined safety engine speed is reached, and then continuing the regulation in such a manner as to maintain the predetermined safety engine speed. It is also advantageous when the controlling step includes reducing the injected fuel amount during the safety driving operation to a level at which the engine operates at a predetermined safety speed, and gradually increasing the injected fuel amount upon the termination of the safety operation in accordance with a ramp function having a predetermined slope to a level determined by the normal input values.

The method of the present invention also has the advantage that, when it is recognized that the regulation displacement has been improperly adjusted, either the adjustment regulation is switched over to a different branch at the input of the adjustment regulator, or, and possibly even simultaneously therewith, a second, redundant, adjustment regulator is put into operation. In this manner, it is possible even to provide protection against deleterious effects of defects which may occur in the normal adjustment regulator. In this connection, there even exists the possibility to put the first or normal adjustment operation back into operation after a failure or defect of temporary nature, once it is established that it operates properly again on the basis of corresponding backswitching criteria.

The present invention also relates to a safety and emergency driving control arrangement for an internal combustion engine with self-ignition used to power a motor vehicle, this arrangement comprising means for continuously monitoring various operating parameters of the engine, including means for generating respective signals indicative at least of gas pedal position, engine operating speed, brake actuation, and actual control-rod displacement; means for evaluating such signals, including means for determining from the signals the occurrence of a safety condition; and means for controlling the operation of the engine on the basis of such evaluation, including regulating means which includes an adjustment regulator, means for supplying to the regulating means a predetermined signal during a normal operation of the engine, means for providing a minimum control rod displacement characteristic behavior signal as a function of the engine speed signal, and means for switching the regulating means from the supplying means to the providing means in response to the determination of the occurrence of the safety condition by the evaluating means.

The regulating means may further include a redundant adjustment regulator connected to the providing means, while the controlling means further includes adjustment means for the amount of injected fuel, the switching means being operative for switching the input of the adjustment means from the adjustment regulator to the redundant adjustment regulator in response to the determination of the occurrence of the safety condition by the evaluating means. The providing means advantageously includes means for evaluating the instantaneous value of the gas pedal signal for control to any regulation displacement desired values. The controlling means may further include additional means associated with the providing means for providing a starting hysteresis which causes the control rod displacement characteristic line signal to move as a function of the engine speed signal to higher injection amount values until a predetermined starting operation termination engine speed is exceeded for the first time.

The present invention also provides for the evaluating and controlling means to include an emergency driving circuitry and an excessive engine speed protection circuitry, and for the sensing means to further include at least one redundant engine speed sensor which provides an additional engine speed signal, and means for furnishing the additional engine speed signal to the emergency driving circuitry for the production of the minimum control rod displacement characteristic line signal, to the excessive engine speed protection circuitry, and to the additional means for providing the starting hysteresis. The furnishing means may then include a dividing circuitry and an engine speed processing circuitry.

It is advantageous when the evaluating means includes means for defining a modified idling signal by evaluating, in addition to the brake actuation signal, a driving speed regulation signal and a gas pedal idling signal, and a reaction member arranged downstream of and controlled by the defining means. Then, the defining means includes a first AND-gate having two inputs respectively receiving the brake actuation signal and the driving speed regulation signal, a second AND-gate having two inputs respective receiving an inverted value of the driving speed regulation signal and a gas pedal idling signal, an OR-gate having two inputs respectively connected to the outputs of the first and second AND-gates and an output carrying the modified idling signal, another AND-gate having two inputs one of which is connected to the output of the OR-gate, and means for supplying to the other of the inputs of the other AND-gate a condition signal indicating the satisfaction of the condition that the actual control rod displacement value exceeds the minimum control rod displacement value. The evaluating means may then further include a delay circuit having an input receiving the output signal of the other AND-gate and the switching means of the controlling means includes a bistable flip-flop having an input connected to the output of the delay circuit. To advantage, the evaluating and controlling means include an emergency driving circuitry, and the output of the flip-flop is used to switch the adjustment regulation over to the emergency driving circuitry. When, as proposed by the present invention, the regulating means includes a redundant adjustment regulator, the output of the flip-flop is used to switch the adjustment regulation from the adjustment regulator to the additional adjustment regulator. Furthermore, when the evaluating means includes a main computer, there is further provided means for furnishing the safety operation condition signal appearing at the output of the flip-flop to the main computer.

The aforementioned main computer may be equipped or associated with means for supervising the operation of the main computer, the supervising means issuing an output signal which is directly utilized for adjustment regulation switching-over. When the regulating means includes a redundant adjustment regulator, it is advantageous when the evaluating means includes a main computer and means for supervising the operation of the main computer, the supervising means issuing an output signal which is directly utilized for switching over to the redundant adjustment regulator.

According to a further development of the present invention, the controlling means further includes additional means associated with the providing means for providing a starting hysteresis which causes the control-rod displacement characteristic line signal to move as a function of the engine speed signal to higher injection amount values until a predetermined starting operation termination engine speed is exceeded for the first time; and wherein the evaluating means includes an additional OR-gate having an output connected to a resetting input of the flip-flop, and two inputs one receiving a signal indicative of the discontinuance of the modified idling signal and the other receiving a signal representative of the existence of the starting hysteresis. The generating means may include a control rod displacement sensor, the regulating means may include means for producing a simulated control rod displacement actual signal from the output signal of the adjustment regulator, and the controlling means may further include means for supervising the operation of the control rod displacement sensor and for switching over to the producing means upon detection of failure of the control rod displacement sensor.

There is further presented by the present invention a safety and emergency driving control arrangement for an internal combustion engine with self-ignition used to power a motor vehicle, this arrangement comprising an adjustment regulator having an integrating section; a substitute regulator; means for continuously monitoring various operating parameters of the engine, including means for generating respective signals indicative at least of gas pedal position, engine operating speed, brake actuation, actual control rod displacement, and control rod deviation and starting position of the adjustment regulator; means for evaluating such signals, including means for determining a failure of the adjustment regulator to reach a starting abutment value upon the expiration of a predetermined time interval; and means for controlling the operation of the engine on the basis of the evaluation performed by the evaluating means, including means for switching to the substitute regulator in response to determination of such failure by the evaluating means.

Under these circumstances, the controlling means advantageously further includes means for supplying to the adjustment regulator, after the switch-over to the substitute regulator, a fixed desired input value while the determining means continues to monitor the starting position of the adjustment regulator, and means for switching back from the substitute regulator to the adjustment regulator after the operability of the adjustment regulator has been recognized from a predetermined number of arrivals at the starting abutment value. Advantageously, the evaluating and controlling means include an emergency driving circuitry which generates a signal for a desired value of control rod displacement in an emergency driving operation, and the controlling means includes means for supplying the desired value signal to the substitute regulator after the switching-over to the latter.

There is also provided a safety and emergency driving control arrangement for an internal combustion engine with self-ignition used to power a motor vehicle, which comprises means for continuously monitoring various operating parameters of the engine, including means for generating respective signals indicative at least of gas pedal position, engine operating speed, brake actuation, actual control rod displacement, and driving speed; means for evaluating such signals, including means for examining the signals generated by the monitoring means for an indication of a sequential occurrence of the gas pedal and brake actuation signals; and means for controlling the operation of the engine on the basis of the evaluation performed by the evaluating means, including means for instituting a safety driving operation only upon the detection by the examining means of the sequential occurrence for avoiding unwarranted reduction in the amount of injected fuel. In this context, it is of advantage when the examining means includes a time-sequence determining circuitry for the gas pedal and brake actuation signals, and an AND-gate having two inputs one of which is actuated by a gas pedal position signal indicative of the absence of the gas pedal from its idling position, and the other having the output signal of the time-sequence determining circuitry applied thereto, and when the instituting means includes means for commencing a waiting period of a predetermined duration at the beginning of the safety driving operation, and means for gradually reducing the injected fuel amount with time in accordance with a first ramp function having a first predetermined slope upon the expiration of the waiting period until a predetermined safety engine speed is reached, for continuing the regulation in such a manner as to maintain the predetermined safety engine speed, and for gradually increasing the injected fuel amount upon the termination of the safety operation in accordance with a second ramp function having a second predetermined slope to a level determined by the normal input values. When the evaluating means includes a main computer, the examining and the instituting means are advantageously incorporated in the main computer.

Owing to the construction of the arrangement of the present invention, the switching-over to the emergency driving operation can be accomplished either by a separate supervision of the function of the main computer by its own supervisory or monitoring system (watchdog), or by the detection of a special redundant idling signal which, in conjunction with the feedback signal indicative of the actual position of the regulating rod causes the switching-over to the redundant adjustment regulator, with which there are separately associated additional components which generate a minimum desired value. These additional components can also be supplied with the engine speed signal from their own independent associated sensor.

A particular advantage of the present invention is to be found in the fact that, upon the occurrence of a safety condition, that is, of irreconcilable external operating condition signals (gas and brake pedal actuated simultaneously), these signals can be put into a time grid and a waiting period can be preselected, so that the injected fuel amount is reduced only after the expiration of the waiting period, and then not abruptly but gradually in accordance with a ramp function of time which has a predetermined slope, thus avoiding operating conditions which could be hazardous.

The novel features which are considered as characteristic of the invention are set forth in particular in the appended claims. The improved control device itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
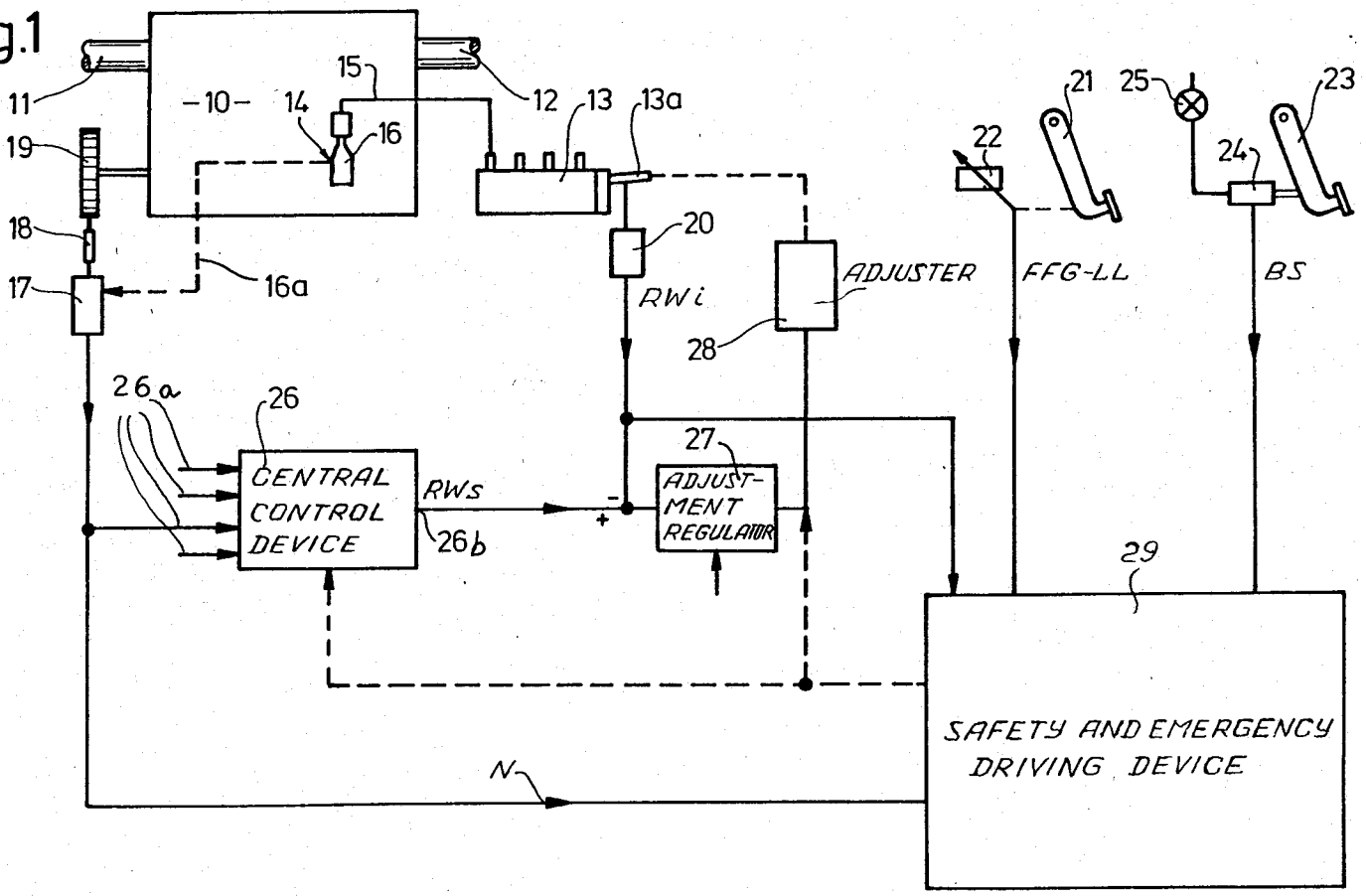
FIG. 1 is a simplified diagrammatic view of an internal combustion engine with self-ignition, and its important associated components inclusive of actual value transducers.

Referring now to the drawing in detail, and first to FIG. 1 thereof, it may be seen that the reference numeral 10 has been used therein to identify a internal combustion engine with self-ignition (Diesel engine). The internal combustion engine 10 includes an itake manifold 11 and an exhaust manifold 12. A fuel injection pump 13 is connected, by means of a pressure conduit 15, with an only diagrammatically illustrated injection valve 14, which is representative of the requisite number of fuel injection valves. The injection valve 14 can include an injection commencement sensor 16 which supplies, via a connecting line **16*a* which is depicted in a broken line, a redundant engine speed signal to an engine speed signal detection and processing device 17**, or which supplies this engine speed signal to separate further processing units.

An engine speed sensor 18 is provided for the determination of the engine speed. The engine speed sensor 18 determines the speed of the internal combustion engine 10, for instance, by means of a ring gear 19 which is driven in rotation by the crankshaft of the internal combustion engine 10. The engine speed sensor 18 has an output which is connected with the engine speed signal detection and processing device 17.

It is to be understood, however, that the manner in which the signals needed for the safety system in accordance with the present invention are obtained is illustrated in FIG. 1 and in the following Figures only in an exemplary fashion; the respectively utilized signals can also be derived in a different manner from the operating conditions of the internal combustion engine 10. It is further to be specifically pointed out that the block diagrams which are presented in the drawings and which depict the present invention on the basis of discrete switching stages do not limit the present invention; rather, they specifically serve the purposes of illustrating the basic functional effects of the invention and of presenting the special functional behaviors in one possible form of implementation of the invention. It is to be further understood that the individual components and blocks can be so constructed as to operate in an analog, digital or hybrid manner, or include, in complete or partial combination, corresponding regions of program controlled digital systems, such as, for instance, microprocessors, microcomputers, digital or analog logic circuits or the like. Therefore, the description of the invention which is presented below is to be considered only as a currently preferred example with respect to the total and time functional behavior which is to be evaluated on the basis of the operating modes which are accomplished by the respective affected blocks and with respect to the respective cooperations of the partial functions which are performed by the individual components, wherein the references to the individual circuit blocks are presented here for the reasons of facilitating the understanding of the present invention.

The block diagram of FIG. 1 further illustrates, in a greatly simplified manner, further means for obtaining the other requisite signals, in addition to an engine speed signal N which appears at an output of the engine speed signal detection and processing device 17. One of these additional signals is an actual value signal RWi of the control rod displacement, which is obtained from the position of a or control rod **13*a* of the fuel injection pump 13, by an actual value generator or transducer 20. Another such additional signal is a gas pedal position signal FFG (of a gas pedal 21), which is, for instance, obtained from the position of a tap of a potentiometer 22 which is mechanically connected with the gas pedal 21. A gas pedal idling signal FFG-LL can also be derived from the gas pedal position signal FFG; however, this gas pedal idling signal FFG-LL can also be produced in a similar manner by a separate idling contact switch provided at the gas pedal 21**.

It is further significant that a braking signal BS is obtained by means of a suitable contact sensor 24 which is associated with a brake pedal 23. The braking signal BS may also additionally operate brake lights 25, or it may be used to separately produce the braking indication signal. Such a braking contact sensor 24 may, however, also be a part of a pressure switch which is arranged in the brake cylinder.

For the electronic control and guidance of the fuel injection pump 13, there is provided a central control device 26 which includes a main computer and further peripheral circuits. As indicated at **26*a*, a plurality of external operating signals, circulation signals and desired value signals is supplied to the central control device 26. Then, the microcomputer incorporated in the central control device 26 produces from such input values or signals at least one output signal RWs for the desired value of the regulation displacement. This output signal RWs is then supplied through an output line 26*b* to an adjustment regulator 27 which is arranged downstream of the central control device 26. The adjustment regulator 27 has a predetermined regulating behavior and, in most instances, is constructed as a so-called PID (proportinal-integral-differential) regulator. The adjustment regulator 27 then controls, via a non-illustrated end stage, an adjuster 28 which displaces the regulation or control rod 13** into its desired position.

All or a part of the signals mentioned here are forwarded, irrespective of the fact that they are also supplied through the inputs 27 to the central control device 26, to a device 29 for controlling operational safety and emergency driving. The device 29 may be constituted by an additional program block in the main computer of the central control device 26, or it may be implemented in any other known manner.

Figure 2:
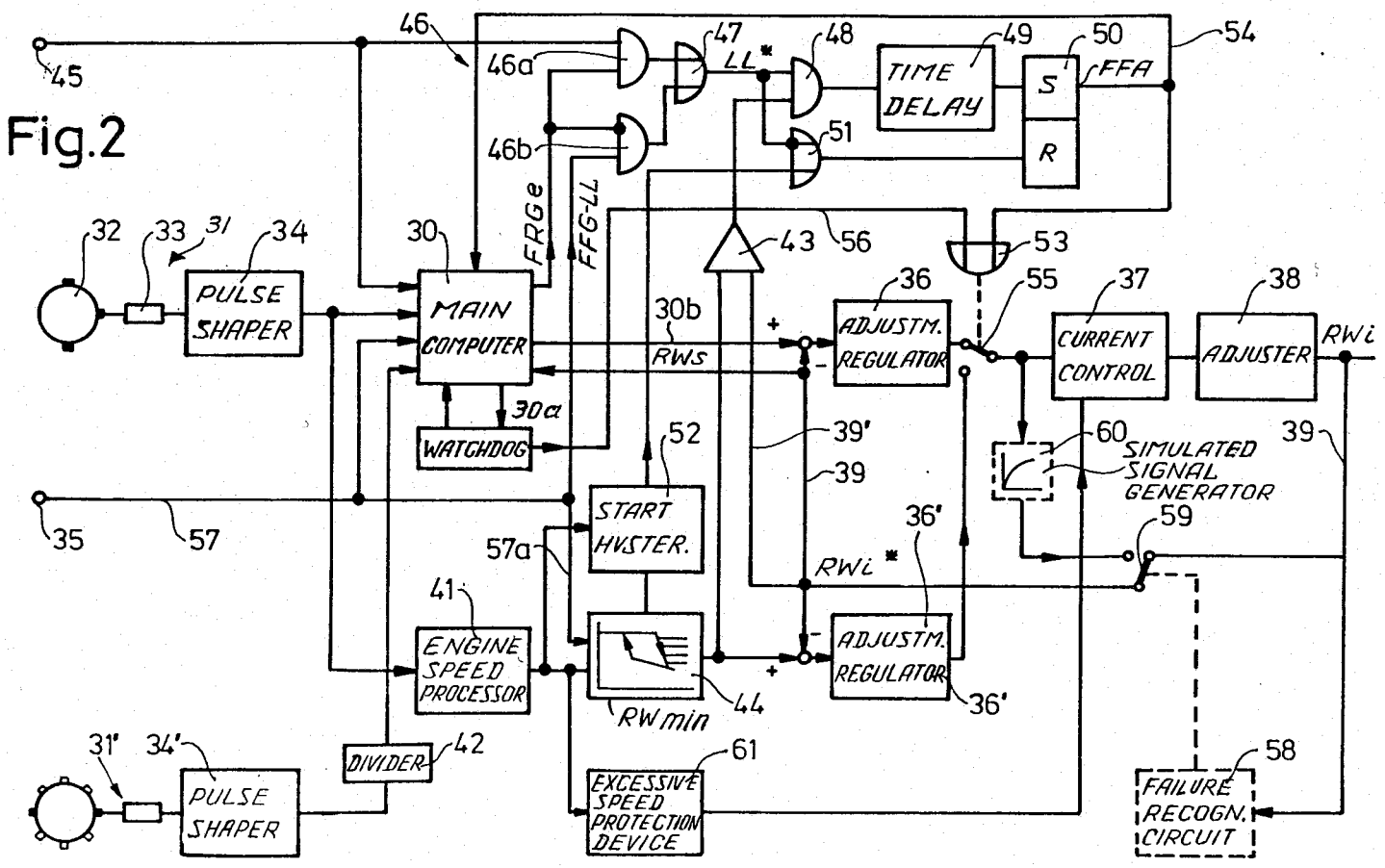
FIG. 2 is a block diagram of a control device for comprehensive safety and emergency driving according to the invention.

A more detailed block diagram of the device 29 for controlling the operational safety and emergency driving of the vehicle is illustrated in FIG. 2. Herein, components belonging to the central control device 26, on the one hand, and to the safety and emergency controlling device 29, on the other hand, are illustrated as being to combined with one another. A main computer is identified by the reference numeral 30, while a supervisory circuit (watchdog) which controls the substantive functions of the main computer 30 and which is associated only with the main computer 30 is identified by the reference numeral 30*a*. A first engine speed signal N is supplied by a normal engine speed sensor 31, which is constituted, for instance, by a disk 32 which is provided with signal markings and rotates in synchronism with the internal combustion engine, a transducer 33 which responds to the markings, and a subsequent pulse-shaping device 34, to the main computer 30 which evaluates this engine speed signal N, as well as the gas pedal signal FFG which is available at an input 35, usually in conjunction with other values which are not of any particular interest in this context, and produces a control rod displacement desired value signal RWs which is supplied through an output line 30*b* to a summer where it is added to a (negative) signal WRi representing the actual value of the control rod displacement. The difference signal is applied to the input of a first adjustment regulator 36 which is advantageously constructed as a PID regulator. A current control device 37 which is connected to the output of the adjustment regulator 36 has an end stage which directly controls an adjuster 38 for displacing the control rod of the injection pump. An actual value RWi of the control rod displacement is fed back through a connecting line 39 and switch 59 to the summer at the input of the adjustment regulator 36. As a result of this, the regulating loop which is needed for the performance of standard regulating functions is closed.

According to one feature of the invention, there is further provided at least one auxiliary or substitute engine speed sensor 31' which is illustrated as having the same construction as the normal engine speed sensor 31 but which may also be an injection commencement indicator. The output signal of the engine speed sensor 31' can be used as a substitute engine speed signal in the event of failure of the normal engine speed sensor 31.

The following conditions are applicable for the starting operation, for the monitoring of the availability of this substitute engine speed sensor 31', and for the use of the latter:

When the electric current is turned on, the starting fuel amount is used as the desired value for the adjustment mechanism regulation; however, the issuance of this particular signal occurs only when a substitute engine speed sensor monitoring arrangement does not establish any errors during the measurement of the inner resistance of the substitute engine speed sensor 31'. An error detection of the substitute engine speed sensor inner resistance leads to the release of the starting fuel amount only after a predetermined engine speed has been reached, as determined from the pulses issued by the normal engine speed sensor 31.

In the event that an injection commencement indicator is utilized as the substitute engine speed sensor 31', then the following functions are modified for the fuel amount and injection commencement regulation:

1. A fixed switch-over engine speed is initially selected for the starting amount switch-over engine speed (that is, for the engine speed at which the fuel amount to be supplied is no longer determined on the basis of starting conditions, but rather is determined from the normal external operating conditions);

2. A switch-over to a modified field of driving performance characteristic curves is completed whereby the following applies with respect to the interpretation of this field of characteristics:

(a) A residual amount is to be predetermined for the injection amount for the gas pedal position O, this residual amount allowing a safe injection commencement evaluation at each engine speed in the useful region (even beyond the regulated range and at engine speed amounting to 0). This residual amount lies below the zero load requirement of the motor.

(b) The full load amount is defined by the uppermost characteristic line in the field of characteristics of the driving performance. This full load amount must lie noticeably below the suction motor full load. Even the regulation engine speed is noticeably reduced (as a component part of the driving performance characteristic field).

(c) The idling engine speed regulation is performed during the idling operation (gas pedal position indicator=0, FFG=0) via the driving performance characteristic field. An idling engine speed which is increased with respect to the normal operation is predetermined.

3. In the event that injection commencement regulation is normally accomplished, there is performed a switch-over to an injection commencement control On the other hand, when a different arbitrary engine speed sensor 31' is utilized instead of the injection commencement sensor, as already mentioned before, then this sensor 31' can be employed at the starter crown gear as an engine speed sensor. In order to obtain even here the engine speed signals which are customary in internal combustion engines with self-ignition (the injection commencement sensor generates a signal, for instance, only once every two crankshaft revolutions), and in order not to overload the main computer 30 by the high engine speed signal frequency which is obtained by the pulse detection via the starter crown gear, a divider arrangement 42 is arranged downstream of a pulse shaping device 34' of the engine speed sensor 31'. The divider arrangement 42 reduces the engine speed signals which are provided for the safety and emergency driving case and which, in this context, are redundant, to approximately the same frequency as encountered in connection with the injection commencement signal BS. It is shown in FIG. 2 that both the normal and the substitute engine speed signals are supplied to the main computer 30, but that the safety and emergency driving arrangements are supplied with the engine speed information via an engine speed processing device 41 from the normal engine speed sensor 31.

However, it is also possible to supply the safety end emergency driving arrangements or a part thereof with the engine speed information from the substitute engine speed sensor 31'.

The other means for enhancing the operational safety and emergency driving which are are shown in FIG. 2 will be explained below in connection with the respective operational safety conditions and with the functions which result therefrom.

In order to examine during a detected idling position of the gas pedal (FFG-LL signal) if the actual control rod displacement value RWi is below a predetermined value RWmin, no simple combination or gating of these values can be performed in the event when the internal combustion engine is operated with a driving speed regulation FGR, which originates at the main computer 30.

Therefore, the actual value RWi of the control rod displacement is supplied through a branch line 39' to one input of a comparator 43, while an RWmin value which is applicable to the respective engine speed is supplied to the other input of the comparator 43 from a RWmin characteristic line generating unit 44. The output signal of this comparator 43 then constitutes a first and necessary signal which is included in this examination. In a driving speed regulation which is accomplished in conjunction with an electronic Diesel regulation (EDC), the gas pedal 21 is in its idling or LL position, and yet a relatively high injection amount corresponding to a large actual displacement signal $RW_1$ in accordance with the need is supplied to the internal combustion engine 10.

Therefore, the FFG-LL detection, which is ordinarily accomplished by the main computer 30, that is, the sensing and evaluation of the idling position of the gas pedal position sensor, must be suppressed during the performance of the driving speed regulation FGR.

It is a feature of the present invention that another so-called redundant, that is additional, idling signal LL* is produced on the basis of a braking signal BS which is supplied to an input 45 and of a driving speed regulation signal (FGR signal). This is accomplished by means of a gating arrangement 46 which is shown in the upper middle region of FIG. 2 and which operates in such a manner that a possible driving speed regulation function FGR cannot result in an erroneous idling position recognition.

In the illustrated construction, the gating is accomplished by means of the gating arrangement 46 which consists of two AND-gates **46*a* and 46*b* and an OR-gate 47 having inputs which are respectively coupled to the outputs of the AND-gates 46*a* and 46*b***. Then, the redundant idling signal LL* appears at the output of this OR-gate 47 only when either no driving speed regulating function is available (which is recognized by the negation or inversion at the corresponding input of the AND-gate **46*b*) and simultaneously an idling signal FGG-LL is available from the gas pedal transducer, or when, even through the driving speed regulating function is available, the brake is actuated. Such a combination must not occur in normal operation, since the FGR function must be eliminated during the actuation of the brake. Both of these signals arrive with the same value through the OR-gate 47** as the LL* signal to one input of a subsequent gating arrangement, namely to another AND-gate 48, which then serves to conduct examination for the simultaneous presence of the redundant idling signal LL* and of the RWmin signal furnished by the comparator 43 and, if need be, to switch over to a regulation displacement which is not dangerous either for the engine 10 or for the driver of a vehicle powered by the engine 10.

Inasmuch as it must be expected here that either a computer delay, or a signal propagation time delay, or a regulating unit delay, will occur, a delay device 49 is connected downstream of the AND-gate 48. The delay device 49 controls a succeeding reaction member 50 for immediate actuation only after a predetermined time period T as elapsed. For the elucidation of its function, the reaction member 50 is illustrated in FIG. 2 of the drawing as a bistable flip-flop having respective setting and resetting inputs S and FR. However, the reaction member 50 can also be implemented in a computer or in any other known manner (such as by setting a flag). The flip-flop constituting the reaction member 50 is set by a signal supplied to its setting input S when the safety case occurs, with the consequences which will be explained in still more detail below, and is reset by a signal supplied to its resetting input R. This resetting occurs, as can be ascertained from FIG. 2 of the drawing, via an OR-gate 51 immediately after the cessation of the redundant idling signal LL* and, additionally, when a signal is supplied from a starting hysteresis device 52, this signal being indicative of a starting operation, as will also be explained.

When a maximum regulation displacement RWmin is preselected with a fixed lower engine speed limiting threshold, then problems are encountered even for the emergency driving operation, since under these circumstances sharp torque jumps may occur at this limiting engine speed when the amount signal which is predetermined by the computer is erroneous. Therefore, according to one feature of the present invention, the engine speed limiting threshold concept is replaced by an engine speed dependent regulation displacement characteristic line for the minimum regulation displacement RWmin. This is indicated in FIG. 2 within the characteristic behavior line generating unit 44 and it is illustrated in detail in the graphic representation of FIG. 3. The RWmin behavior as a function of time is shown in solid lines in FIG. 3. It is to be added hereto that all functions which are described here in the form of characteristic lines may also be so chosen as to be more or less complex and it is to be understood that in each instance, and also here and in the following explanation, there will be described a minimum status which still has meaningful results.

Figure 3:
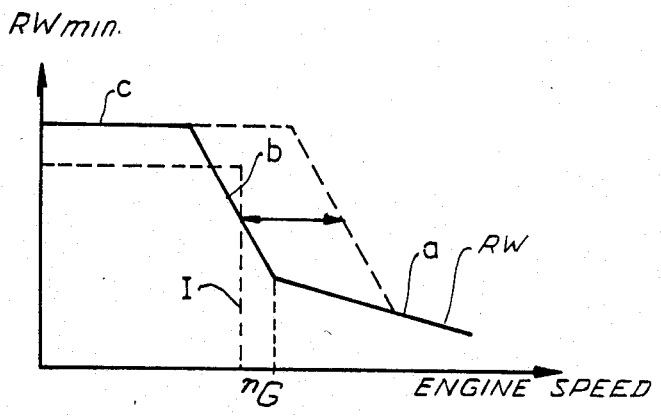
FIG. 3 is a graphic representation of the dependence of a control rod displacement as predetermined for the emergency driving condition on the engine speed, incorporating a so-called starting hysteresis.

The RWmin characteristic line as a function of time consists of three sections a, b and c, wherein the section a lies upwardly of an already mentioned threshold engine speed which is indicated in FIG. 3 at $n_G$ and which predetermines regulation displacements that lie below a zero-load fuel amount requirement of the engine but above a regulation displacement which is issued by the main computer 30 for the idling position of the gas pedal when the operation is undisturbed. The section b of the RWmin charcteristic line, which rises below the limiting engine speed, allows an idling regulation during the emergency driving operation, but it lies above the idling regulation characteristic line for the normal operation, while the remaining section c permits regulation displacements which render a cold start possible.

On the other hand, such a RWmin characteristic line behavior may endanger an automatic starting amount control by the electronic Diesel regulator arrangement EDC, which tends to release more fuel (corresponding to a greater regulation displacement RW) during the cold start operation than that permitted in accordance with the RWmin characteristic line shown in FIG. 3. Therefore, in accordance with a fact of the present invention, this RWmin characteristic line is provided with a hysteresis for the starting case, which is recognized by the starting hysteresis device 52 shown in FIG. 2 of the drawing that may also be responsible for the change in the RWmin characteristic behavior which will be explained in more detail presently. This hysteresis is indicated in FIG. 3 of the drawing by a broken line identified by the designation RWmin' and is operative for causing a shift in the direction toward the higher engine speeds at the time of the first switching-on. Simultaneously, in the diagrammatic representation of FIG. 3, there is further shown in dash-dotted lines, and identified by the reference character I, the normal starting amount behavior as a function of the engine speed.

After the normal starting termination engine speed (inclusive of a safety distance) has been exceeded for the first time, the operation is again returned from the RWmin', that is from the widened hysteresis configuration, to the normal RWmin characteristic behavior line.

The comparator 43 compares the RWmin value obtained from the RWmin characteristic behavior line with the actual RWi value. If an erroneous adjustment of the regulation displacement RW is established during this comparing operation, that is, if the value of RWi is greater then RWmin and simultaneously the idling condition LL* is encountered, then the flipflop constituting the reaction member 50 is set after the expiration of a time delay period which is predetermined by the timedelay block 49. The flip-flop 50 then switches, via its output FFA and an OR-gate 53 which is connected downstream of the flip-flop 50, the position regulation of the regulation displacement over to a second branch which then, that is when the safety condition has been encountered, regulates to the RWmin characteristic behavior line which has just been thoroughly discussed, and simultaneously announces this encountered safety condition via a feedback line 54 to the main computer 30.

In order to be able to regulate to the RWmin characteristic behavior line when the safety condition for the emergency driving operation is encountered, either the input of the adjustment regulator 36 may be connected, in a manner which is not illustrated in FIG. 2 of the drawing but will be readily apparent to those active in this field, with the output of the characteristic behavior line generating unit 44, which means that one and the same adjustment regulator 36 as before continues to be used, or, in the alternative, it is possible to switch over to the second redundant adjustment regulator 36', which switch-over is achieved, as illustrated in FIG. 2, by an actuation of a switch 55 from the output of the flip-flop 50, inasmuch as there is obtained in this manner protection even against possible defects of the normal adjustment regulator 36.

Such a switch-over to the second redundant adjustment regulator 36, which is obtained by means of the OR-gate 53 and the switch 55, is accomplished as well when it is established, namely, by means for the supervisory or watchdog circuit **30*a* of the main computer 30, that the main computer 30 by itself is not operational, for instance, as a result of being defective, having too low a voltage or the lie. Under these circumstances, the supervisory or watchdog circuit 30 switches the switch 55 over to the second redundant adjustment regulator 36' as well, via a connecting line 56 and the OR-gate 53**.

The resetting of the security switch-over flip-flop 50 occurs in each case when, as already mentioned before, the idling operation condition LL* is lifted again, or to bring the flip-flop 50 in the defined initial position via the starting hysteresis device 52 during the occurrence of the starting conditions.

The feedback of the switching-over to the main computer 30 via the feedback line 54 is necessary since, as the case may be, the main computer 30 itself performs a supervision for the regulation deviation, or in order to manipulate the main computer 30 in the desired sense, since the main computer 30 could otherwise, during this supplementary redundant switchingoff, even shut off the entire system via an additional regulator (for instance, a shutoff valve for the fuel).

An additional measure for achieving a clean operation by means of the RWmin characteristic behavior curve is to additionally supply to the RWmin characteristic behavior line generating unit 44, via a branch line **57*a* of the line 57 from the gas pedal indicator or sensor, a gas pedal signal FFG which, when added to the generated RWmin signal, renders it possible to achieve control into any arbitrary position, so that a continued emergency driving operation is possible in a simple manner even when the operation of the main computer 30** is discontinued or when the components which are involved in the respective safety incident becomes inoperative.

A further feature of the present invention is to be found in the fact that a recognition circuit 58 is provided for the recognition of the failure of the regulation displacement sensor. Therefore, the actual value signal which is generated by the regulation displacement sensor and which is being fed back is additionally supplied to the recognition circuit 58.

Arbitrarily selected input signals which are coupled with the actual position of the regulation displacement are supplied to the recognition circuit 58. Herein, the regulation displacement failure recognition can be accomplished by resorting to the use of the otherwise known measure of a so-called signal range check. Then, when it has been established that the regulation displacement sensor has failed, and correspondingly to a feature of the present invention, the signal which is supplied to the position regulating arrangement (the position regulators 36 and 36'), or to the main computer 30 no longer is the true (but, under these conditions, no longer applicable) regulation value signal RWi; rather, it is a simulated signal which is a made available by a switch-over of a switch 59, which is effected by the recognition circuit 58, to an RWi* generating device 60. This simulated signal is derived either from the adjustment regulator output, as illustrated in FIG. 2, or even from other available values, such as, for instance, from the output signal of the current regulator 37 which is arranged downstream of the adjustment regulator. Insofar, even the RWi generating device is an observation device for the adjuster 38 for the general case.

It will be appreciated that, as already known by itself, in addition to the measures which have been taken so far, there is also provided an excessive speed protection circuit 61 which acts directly on the end stage of the current regulator 37, bypassing all other components and acts to prevent excessive engine speeds.

Therefore, essential features of the present invention reside in the generation, in addition to the signal produced by the engine speed sensor 31' or by the injection commencement sensor, there is also generated a redundant idling speed signal LL*, as well as in the provision of the RWmin characteristic behavior line, which additionally may be subjected to shifting for widened emergency driving operation due to signals of the gas pedal sensor.

The RWmin characteristic behavior line is subjected to the supplemental widening due to the provision of a starting hysteresis function so that, besides the widened emergency driving operation, starting procedures are also still possible. The switching-over to the emergency driving operation occurs selectively due to the actuation of a reaction element, namely the flip-flop 50, but also by means of the watchdog device directly associated with the computer in response to the feedback announcement of the switch-over of the flip-flop. There is preferably provided a redundant adjustment regulator, which is rendered operative for the safety condition and for the emergency driving operation from the RWmin characteristic behavior curve generation. Furthermore, an actual value magnitude, which can be evaluated for the emergency driving operation, can be obtained by the generation of a simulated regulation displacement signal. As a result of the inclusion of the adjuster observation device corresponding to the RWi* generation circuit 60 into the supervision program, even the adjustment behavior can be examined or monitored.

A further problem for a general safety and emergency driving operation with self-igniting internal combustion engines is to be found in the possibility that the gas pedal may become stuck or is unable to return to its idling operation position, the signal evaluation of the gas pedal sensor in the control device is faulty or erroneous, or when its signal is erroneously interpreted by the computer. Under these circumstances, there exists the danger that, even though the driver has ceased to depress the gas pedal, that is, the FFG-LL signal is available, fuel continues to be undesirably injected in excess of the amount required for the existing driving conditions. Even though it would be possible to prevent such undesirable fuel addition by additionally incorporating a braking signal BS which is effected by the normal driver reaction as a redundant safety signal, as was done in the structure depicted in FIG. 2 of the drawing, there would be created problems during certain cases of driving operation which have been already mentioned before, for instance, when the driver temporarily depresses the brake pedal during travel at high speed, while the gas pedal is not in its idling position, or when occasionally the gas and brake pedals are actuated simultaneously, for instance, for approximating a kind of an anti-skid regulation or during very sporty driving. Therefore, when the injected fuel amount is abruptly reduced or eliminated in these instances and the regulation is performed toward a regulation displacement which reliably delivers the injection amount of 0 or the end stage for the fuel pump adjustment arrangement is even shut off entirely, there can come into being dangerous driving conditions since, in the last-mentioned case, the adjustment regulator of the adjustment arrangement runs into an abutment, so that transient phenomena with undesirably long durations and involving, at least in part, considerable injected fuel amount overshoots may be encountered under these circumstances and in any event the abrupt switching-off or removal of the injected fuel amount during the driving operation causes a considerable deceleration of the vehicle.

Therefore, in accordance with a currently preferred feature of the present invention which is also inventive independently and by itself, it is proceeded in the event of the brake pedal actuation in such a manner that an abrupt removal of the injected fuel amount in the above-discussed cases is avoided. This is achieved in that, in accordance with the situation illustrated in FIG. 4 of the drawing, the triggering of the safety condition for the computer occurs only when 1. the gas pedal is not in its idling position ($\overline{\text{FFG-LL}}$), and 2a. either the gas pedal is not initially in its idling position and the brake actuation signal BS occurs at a later point in time, or 2b. the brake is actuated first (signal BS) and the gas pedal is displaced out of its idling position at a later point in time and, in this case, the driving speed is further greater than a predetermined minimum safety speed, that is, $V > V_{smin}$.

It will be appreciated that these conditions are not the be considered statically by themselves. While it is true that the safety operation is to be discontinued again when the LL position of the gas pedal is recognized or the brake is released again, this is not applicable, for instance, when the speed condition which is possibly still needed for effecting the triggering ceases to exist after the safety operation has been triggered and the conditions "brake pedal depressed, FF≠LL" still exist.

Figure 4:
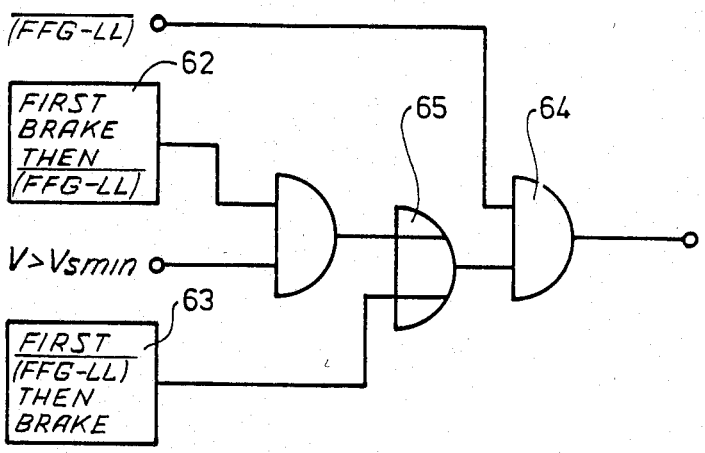
FIG. 4 is a circuit diagram of an electronic circuitry which incorporates discrete gate circuits and constitutes a possibility of processing external values for the determination of a safety condition upon the occurrence of which a switch-over or regulation in accordance with predetermined characteristic lines is the be accomplished.

To this end, evaluation blocks 62 and 63 which are depicted in FIG. 4 of the drawing constitute switching means which are able to detect the time correlation or an occurrence in a time sequence of the events and which issue a signal only when the conditions which are listed in the respective blocks 62 and 63 are satisfied. Consequently, the safety condition which corresponds, in the case assumed here, to the signal at the output of an output gate (AND-gate 64) going high, results only when the signal "gas pedal is not in its idling position" (FFG-LL) is supplied to one of the inputs of the AND-gate 64, while a signal representative of the occurrence of either one of the conditions **2*a* or 2*b* is simultaneously supplied to the other input of the AND-gate 64 from a preceding OR-gate 65**.

Figure 5:
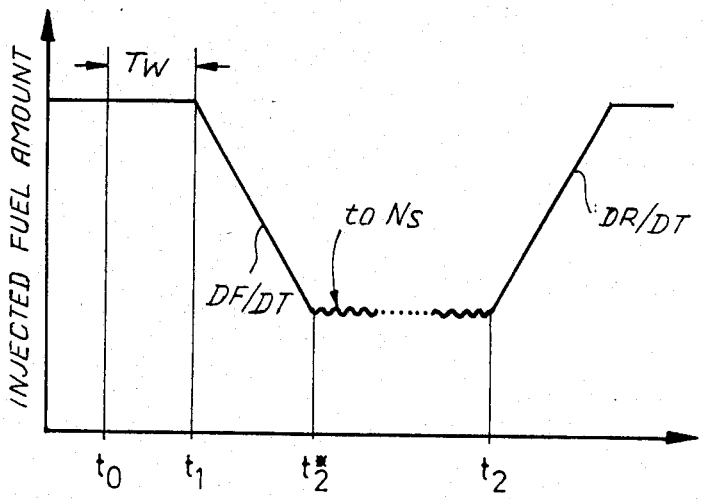
FIG. 5 is a graphic representation of the dependence of the supplied injection fuel amount in the event of the safety condition on time.

As soon as this safety situation arises, there is performed processing in accordance with the diagram of FIG. 5 of the drawing, which depicts the dependence of the amount of the injection fuel supplied on time. Accordingly, at the occurrence of the safety condition, a waiting time $T_w$ is started first and, after the expiration of this waiting time $T_w$, the injection fuel amount is reduced, but not abruptly; rather, the injection fuel is performed gradually, in the form of a ramp function of time which has a predetermined inclination DF/DT. In this manner, there is obtained regulation to a preselectable safety engine speed $N_s$. The ordinary idling regulation parameters may be applicable to this regulation.

Immediately after the discontinuance of the safety situation (which means that one of the two conditions "brake pedal actuated" or "FFG≠LL" is no longer true), that is, in FIG. 5 of the drawing at the point $t_2$ in time, wherein the point $t_0$ in time signifies the commencement of the safety situation, the point $t_1$ in time the expiration of the waiting period $T_w$ and the point $t_2$* in time the reaching of the safety engine speed $N_s$, the injection fuel amount is again gradually increased with time in the form of a ramp function with a predetermined inclination DR/DT to the amount which is predetermined by the normal input values of the control arrangement (FFG, FGR, . . . ).

In this manner, the otherwise encountered conflict "brake/gas pedal" is resolved and also hard fuel amount pulses are avoided. As a result of the additional introduction of the driving speed safety threshold $N_S$, there is obtained an additional degree of freedom for the layout. It is also important that, when using the safety situation layout of this kind, the adjustment regulator does not, or the adjustment regulators do not, run into any abutment or abutments.

Inasmuch as only the input values FFG of the gas pedal sensor and BS of the brake pedal sensor, which are supplied to the main computer 30 in any event as illustrated in FIG. 2 of the drawing, are needed for this special safety problem, there results a further advantage that this entire safety function can be transferred into the main computer 30, that is, the main computer 30 may be so constructed as to perform this function, so that a substantially reduced circuitry expenditure results as well.

Figure 6:
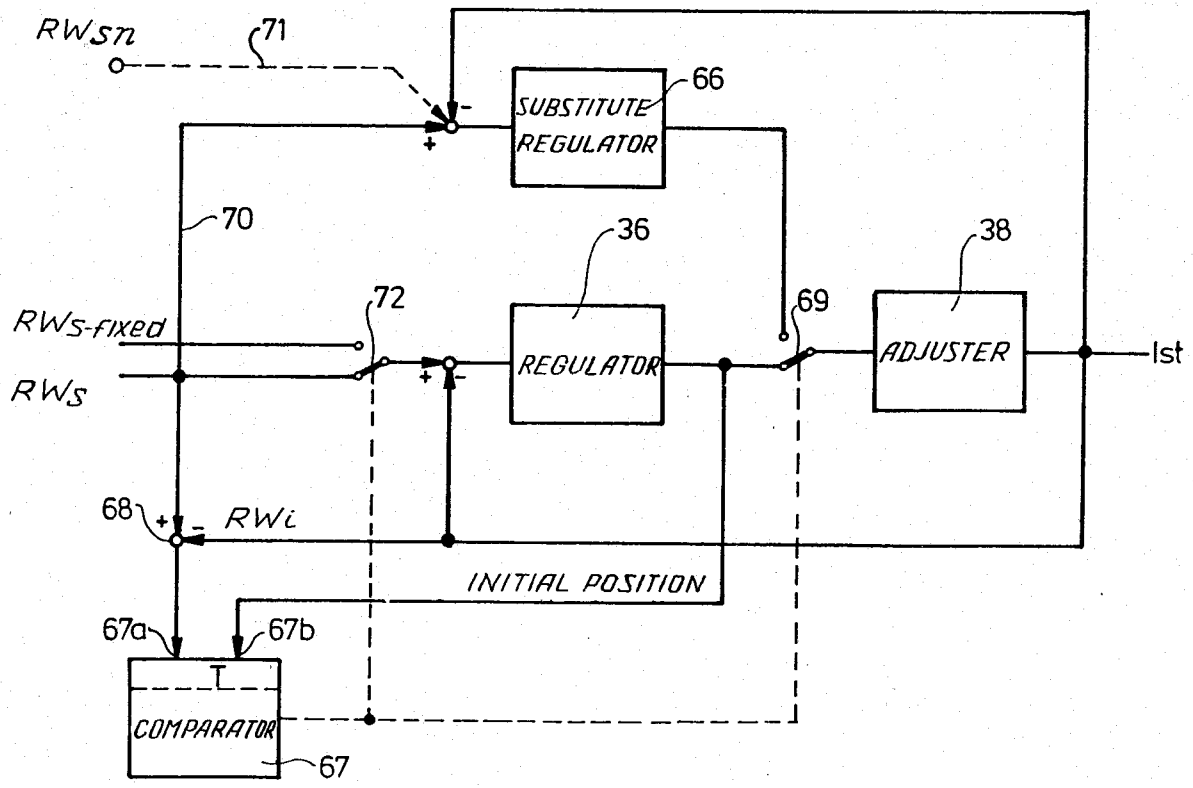
FIG. 6 is a circuit diagram of an electronic circuitry incorporating the possibilities of switching over to a substitute regulating arrangement while simultaneously continuously monitoring the operation of an initially employed regulating arrangement for the possibility of restoring the same to use.

Finally, a further supplementing feature of the present invention, which is of an inventive significance also independently and by itself, can be ascertained from FIG. 6 of the drawing. What is involved here is the possibility, which has been already alluded to before, of making use of a second adjustment regulator or substitute regulator, which is identified in FIG. 3 by the reference numeral 66. On the other hand, the normal regulator is identified in the same manner as in FIG. 2 of the drawing by the reference numeral 36.

It is true that the safety and emergency driving system depicted in FIG. 2 of the drawing is already also provided with a second and hence redundant regulator 36'; however, this second regulator 36' of FIG. 2 may be utilized in this system only on an optional basis, inasmuch as in the safety situation merely the adjustment regulation of the regulation displacement is switched over to the second branch, which is constituted by the components 44 and 52, so that the further regulation is accomplished in accordance with the RWmin characteristic behavior line. This switching-over of the second branch may, however, also take place to the original adjustment regulator. In contradistinction thereto, the redundant adjustment regulator 66 which is effectively provided in accordance with FIG. 6 increases the availability of the whole system and thus also of the vehicle. Herein, the provision of the redundant adjustment regulator 66 is based on the following considerations. In EDC systems, the fuel injection amount is metered via an electromagnetic adjuster 38' (see FIG. 6) with position feedback (the position of the regulating rod - RWi sensor) and an adjustment regulator in the control arrangement. In the event of failure of this single adjustment regulator 36, there is no way in which a fuel amount metering could be accomplished, so that even the vehicle equipped with such an internal combustion engine comes to a standstill.

In this connection, the present invention provides a second substitute adjustment regulator 66 or redundant regulator, and further renders available means which recognize whether or not the normal adjustment regulator 36 is capable of performing its function, in order to switch over to the substitute adjustment regulator 66 if necessary. It will be appreciated that such measures may also be used for other adjustment regulators for other parameters, for instance, for an exhaust gas recirculation rate ARF, injection commencement or the like.

The actual regulator (PID) itself and, in an extension also the associated subsequent stages inclusive of the end stage (the current regulator 37) may be considered to be constituent components of such an adjustment regulator. Inasmuch as an adjustment regulator, as already mentioned before, generally includes an I (integration) part, it is possible to assume that, when a regulation deviation is present, the regulator output moves toward the maximum position which is possible for the correction of this deviation, so that it moves to the abutment. Herein, the direction of the deviation and the direction of the regulator at the abutment are associated with one another as far as their senses are concerned. This association and the requirement that the regulator move toward the abutment render it possible to examine or test the adjustment regulator and the possibly provided subsequent stages, while observing the principle that, when the regulation deviation is present and when this regulation deviation exists for a predetermined fixed time interval, it is possible to determine if the regulator output has arrived at the proper abutment. If this is not the case, then it is necessary to switch over to the substitute regulator 66. According to FIG. 6 of the drawing, the present invention proposes the use of a comparison device 67 having two inputs **67*a* and 67*b*, wherein the regulation deviation is supplied to the input 67*a* and the initial position of the regulator to the input 67*b*. Herein, the regulation deviation is obtained in the usual manner at a summing point 68, to which there are supplied the regulator rod desired value RWs from the main computer 30 and the regulator rod actual position RWi from the RWi sensor. If it is determined that, after the expiration of the fixed time interval $\tau$, the regulator rod initial position does not correspond to the abutment, then the comparator 67, by means of a switch 69, switches over to the substitute regulator 66, which then either can operate further also with the previous desired value (which is supplied to it through a connecting line 70), or to which there can be supplied by a connecting line 71, also from the emergency driving arrangement, a separate desired value which is also derived from such arrangement as RWsn (see the block 44 in FIG. 2). A failure of the normal adjustment regulator 36** in the latter case always means a complete switching-over to the emergency driving branch, which provides a simplification of the logic circuitry under certain circumstances.

Inasmuch as such a switch-over could also be triggered by a single disturbance and a reverse switching out of the emergency driving operation is no longer possible with the heretofore explained means, even though the operability of the normal regulator 36 is not disturbed or is no longer disturbed, the desired value input of the regulator 36 which has been (preliminarily) recognized as being defective is switched over, in accordance with a further feature of the present invention, also by the output of the comparator 67 by actuating a switching arrangement 72, to a fixed desired value. Herein, this fixed desired value is preferably in the center of the normal operation range. Under these circumstances, the comparator 67 continues to observe or monitor the output of the normal regulator 36.

In view of the fact that the substitute adjustment regulator 66 continues to operate with the changing desired values RWs or RWsn which result during the driving operation, the normal regulator 36 will necessarily be exposed to alternating positive and negative regulation deviations with respect to its fixed desired value, inasmuch as the RWi input is continued to be supplied thereto. Thus, when the operability of the adjustment regulator 36 is restored, that is, when the adjustment regulator 36 is operative again, it would have to alternatingly strike one or the other of the abutments.

It is then possible to select a predetermined number of abutment alternations, which can be detected by the comparator arrangement 67, upon the reaching of which the comparator arrangement 67 can switch back to the normal function, so that it is possible to exit the emergency driving function, with the advantages stemming therefrom, and with the further advantage that the emergency driving function is again available for use if the need for it arises.

It will be understood that each of the elements described above, or two or more together, may also find a useful application in other types of arrangements differing from the type described above.

While the invention has been illustrated and described as embodied in a method of and arrangement for safety and emergency driving operation for an internal combustion engine with self-ignition as used to power a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

We claim:

1. A safety and emergency driving control method for an internal combustion engine with self-ingition used to power a motor vehicle, comprising the steps of continuously monitoring various operating parameters of the engine, including generating respective signals indicative at least of gas pedal position, engine operating speed, brake actuation, and actual control rod displacement; evaluating such signals, including determining simultaneous occurrence of a modified idling operation condition and of a predetermined minimum value of the actual control rod displacement signal; and controlling the operation of the engine on the basis of said evaluation step, including controlling the control rod displacement in a predetermined manner in the absence of such simultaneous occurrence, and switching, in the presence of such a simultaneous occurrence, to another regulation branch which controls the control rod displacement in accordance with a minimum value characteristic line of the control rod displacement.

2. The method as defined in claim 1, wherein said controlling step further includes adding the signal indicative of the gas pedal position to an engine speed dependent minimum value of the control rod displacement from the characteristic line of the control rod displacement for emergency driving operation to obtain a new desired displacement value which renders a broadened emergency driving possible.

3. The method as defined in claim 2, wherein said controlling step further includes switching the adjustment regulation with the new characteristic line dependent and gas pedal dependent desired value of the control rod displacement from a normal adjustment regulator to an auxiliary redundant regulator for simultaneous protection against disturbances in the operation of the normal adjustment regulator.

4. The method as defined in claim 1, wherein said controlling step further includes producing the characteristic line of the control rod displacement minimum value for the emergency driving operation from the engine speed as determined by an engine speed sensor during the performance of said generating step.

5. The method as defined in claim 4, wherein said generating step includes employing the engine speed sensor for effectively sensing injection commencement.

6. The method as defined in claim 4, wherein said generating step includes employing the engine speed sensor for sensing rotation of a crankshaft of the engine, and reducing the number of the redundant signals obtained from the engine speed sensor by division.

7. The method as defined in claim 1, wherein for emergency driving an engine speed dependent minimum value characteristic line of the control rod displacement including a starting hysteresis function is generated, the hysteresis function releasing an additional fuel amount in dependence on the engine speed for the cold start and switching over to the normal minimum value characteristic line of the control rod displacement upon the reaching of a normal starting termination engine speed for the first time.

8. The method as defined in claim 1, wherein said evaluating step includes, for the presentation of the modified idling operation signal, performing at least one of comparisons of a brake pedal actuation signal with a driving speed regulating signal, and of a non-occurrence of the driving speed regulating signal with a foot pedal normal idling operation signal; and wherein said controlling step includes utilizing the modified idling operation signal to cause permanent switching-over only after the expiration of a predetermined time delay and when a condition that the actual regulation displacement value exceeds the minimum regulation displacement value is simultaneously satisfied.

9. The method as defined in claim 8, wherein said controlling step additionally includes selectively circumventing said utilizing step and using a signal directly issued by a separate monitoring device associated with a main computer for achieving the permanent switching-over.

10. The method as defined in claim 1, wherein said evaluating step includes detecting a failure of an actual control rod displacement value sensor, and switching over to a simulated actual regulation signal derived from the output of an adjustment regulator.

11. The method as defined in claim 10, wherein said evaluating step further includes, for achieving a permanent switching-over, setting a reaction component, and resetting the reaction component in the absence of the modified idling signal.

12. The method as defined in claim 11, wherein the engine speed dependent characteristic line of the control rod displacement controls a starting hysteresis function which releases an additional fuel amount in dependence on the engine speed for the cold start and which switches over to the minimum value characteristic line of the control rod displacement upon the reaching of a normal starting termination engine speed for the first time; and wherein said resetting of said reaction component is performed even during the occurrence of the starting hysteresis function.

13. A device for controlling operational safety and emergency driving of an internal combustion engine with self-ignition used to power a motor vehicle, comprising means for continuously monitoring various operating parameters of the engine, including means for generating respective signals indicative at least of gas pedal position, engine operating speed, brake actuation, and actual control rod displacement, and driving speed; means for evaluating such signals, including means for examining the signals generated by said monitoring means for an indication of a sequential occurrence of the gas pedal and brake actuation signals; and means for controlling the operation of the engine on the basis of such evaluation performed by said evaluating means, including means for initiating a safety driving operation only upon the detection by said examining means of said sequential occurrence for avoiding unwarranted reduction in the amount of injected fuel.

14. The device as defined in claim 13, wherein said examining means includes a time-sequence determining circuitry for the gas pedal and brake actuation signals, and an AND-gate having two inputs one of which is activated by a gas pedal position signal indicative of the absence of the gas pedal from its idling position, and the other having the output signal of said time-sequence determining circuitry applied thereto; and wherein said initiating means includes means for commencing a waiting period of a predetermined duration at the beginning of the safety driving operation, and means for gradually reducing the injected fuel amount with time in accordance with a first ramp function having a first predetermined slope upon the expiration of the waiting period until a predetermined safety engine speed is reached, for continuing the regulation in such a manner as to maintain the predetermined safety engine speed, and for gradually increasing the injected fuel amount upon the termination of the safety operation in accordance with a second ramp function having a second predetermined slope to a level determined by the normal input values.

15. The device as defined in claim 14, wherein said evaluating means includes a main computer; and wherein said examining and said instituting means are incorporated in said main computer.

* * * * *